US010232430B2

(12) United States Patent
Müller et al.

(10) Patent No.: US 10,232,430 B2
(45) Date of Patent: Mar. 19, 2019

(54) MOULD MATERIAL MIXTURE HAVING IMPROVED FLOWABILITY

(71) Applicant: ASK Chemicals GmbH, Hilden (DE)

(72) Inventors: Jens Müller, Haan (DE); Diether Koch, Mettman (DE); Marcus Frohn, Dormagen (DE); Jörg Körschgen, Köln (DE)

(73) Assignee: ASK Chemicals GmbH, Hilden (DE)

( * ) Notice: Subject to any disclaimer, the term of this patent is extended or adjusted under 35 U.S.C. 154(b) by 0 days.

(21) Appl. No.: 14/852,942

(22) Filed: Sep. 14, 2015

(65) Prior Publication Data

US 2016/0059301 A1 Mar. 3, 2016

Related U.S. Application Data

(62) Division of application No. 12/740,859, filed as application No. PCT/EP2008/009177 on Oct. 30, 2008, now abandoned.

(30) Foreign Application Priority Data

Oct. 30, 2007 (DE) ..... 10 2007 051 850

(51) Int. Cl.
*B22C 1/16* (2006.01)
*B22C 1/18* (2006.01)
(Continued)

(52) U.S. Cl.
CPC ..... *B22C 1/167* (2013.01); *B22C 1/04* (2013.01); *B22C 1/186* (2013.01); *B22C 1/188* (2013.01);
(Continued)

(58) Field of Classification Search
None
See application file for complete search history.

(56) References Cited

U.S. PATENT DOCUMENTS 3,409,579 A 11/1968 Robins
3,826,658 A 7/1974 Nicholas
(Continued)

FOREIGN PATENT DOCUMENTS

CA 980084 12/1975
CA 2 666 760 A1 4/2008
(Continued)

OTHER PUBLICATIONS

International Search Report dated Mar. 31, 2009 which was received in corresponding International Application No. PCT/EP2008/009177.
(Continued)

*Primary Examiner* — Devang R Patel
(74) *Attorney, Agent, or Firm* — Locke Lorde LLP; Alan B. Clement; Peter J. Fallon

(57) ABSTRACT

The invention relates to a mold material mixture for producing casting molds for metal processing, a process for producing casting molds, casting molds which can be obtained by the process and their use. The production of the casting molds is carried out using a refractory base molding material and a binder based on water glass. A proportion of a particulate metal oxide selected from the group consisting of silicon dioxide, aluminium oxide, titanium oxide and zinc oxide is added to the binder, with particular preference being given to using synthetic amorphous silicon dioxide. The mold material mixture contains a surface-active material as further significant constituent. The addition of the surface-active material enables the flowability of the mold material mixture to be improved, which makes it possible to produce casting molds having a very complicated geometry.

20 Claims, 1 Drawing Sheet

(51) Int. Cl.

| | |
|---|---|
| ***B22C 1/26*** | (2006.01) |
| ***B22C 1/04*** | (2006.01) |
| ***B22C 1/24*** | (2006.01) |
| ***B22C 9/12*** | (2006.01) |

(52) U.S. Cl.
CPC ..... *B22C 1/24* (2013.01); *B22C 1/26* (2013.01); *B22C 9/12* (2013.01); *B22C 9/123* (2013.01)

(56) References Cited

U.S. PATENT DOCUMENTS

| | | | | |
|---|---|---|---|---|
| 3,857,712 | A * | 12/1974 | Chevriot | B22C 1/188 106/38.3 |
| 4,006,027 | A * | 2/1977 | Lyass | B22C 1/2293 106/123.11 |
| 4,162,238 | A | 7/1979 | Bergna | |
| 4,316,744 | A | 2/1982 | Bergna | |
| 4,735,973 | A | 4/1988 | Brander | |
| 5,474,606 | A | 12/1995 | Twardowska et al. | |
| 5,582,232 | A | 12/1996 | Bambauer et al. | |
| 5,711,792 | A * | 1/1998 | Miller | B22C 1/185 106/38.2 |
| 6,139,619 | A | 10/2000 | Zaretskiy et al. | |
| 6,972,059 | B1 | 12/2005 | Skerdl | |
| 7,022,178 | B1 | 4/2006 | Steinhauser | |
| 7,770,629 | B2 | 8/2010 | Weicker et al. | |
| 8,741,194 | B1 | 6/2014 | Ederer et al. | |
| 2001/0050031 | A1 | 12/2001 | Bredt et al. | |
| 2005/0003189 | A1 | 1/2005 | Bredt et al. | |
| 2008/0099180 | A1 | 5/2008 | Weicker et al. | |

FOREIGN PATENT DOCUMENTS

| | | | | |
|---|---|---|---|---|
| CA | 2 666 761 | A1 | 4/2008 | |
| CA | 2 678 292 | A1 | 8/2008 | |
| DE | 2024861 | | 5/1970 | |
| DE | 2 059 538 | | 6/1971 | |
| DE | 2434431 | | 7/1974 | |
| DE | 2856267 | | 12/1978 | |
| DE | 29 09 107 | | 9/1979 | |
| DE | 233319 | A1 | 12/1984 | |
| DE | 239362 | A1 | 7/1985 | |
| DE | 4306007 | A1 * | 9/1994 | B22C 5/02 |
| DE | 69 734 315 | T2 | 12/1997 | |
| DE | 199 25 167 | | 12/2000 | |
| DE | 10 2004 042 535 | A1 | 3/2006 | |
| DE | 10 2004 057669 | | 7/2006 | |
| EP | 0796681 | A2 | 9/1997 | |
| EP | 0 917 499 | B1 | 11/2000 | |
| EP | 1 095 719 | A2 | 5/2001 | |
| GB | 782205 | | 9/1957 | |
| GB | 1 299 779 | A | 12/1972 | |
| GB | 2 016 483 | | 9/1979 | |
| JP | 55-501134 | A | 12/1980 | |
| JP | 59-141342 | A | 8/1984 | |
| JP | 63-115649 | A | 5/1988 | |
| WO | WO 80/01254 | | 6/1980 | |
| WO | WO 95/15229 | | 6/1995 | |
| WO | WO 97/49646 | | 12/1997 | |
| WO | WO 98/06522 | | 2/1998 | |
| WO | WO 2001/39911 | | 6/2001 | |
| WO | WO 02/26419 | A1 | 4/2002 | |
| WO | WO 2006/024540 | | 3/2006 | |
| WO | WO 2006/058664 | | 6/2006 | |
| WO | WO 2008/046651 | | 4/2008 | |
| WO | WO 2008/046653 | | 4/2008 | |
| WO | WO 2008/101668 | | 8/2008 | |

OTHER PUBLICATIONS

Written Opinion of the International Searching Authority received in corresponding international Application No. PCT/EP2008/009177.

Mike Stevenson in "Chemical binders—back to basics," published in Foundry Trade Journal, Institute of Cast Metals Engineers, West Bromwish, GB, Bd. 167, Nr. 3476, Jun. 4, 1993, pp. 311-312, 314-316, 318-319.

Walter Ellinghaus in "Kernherstellungsverfahren der neunziger jahre," published in Giesserei, Giesserei Verlag, Dusseldorf, DE, vol. 80, Nr. 5, Mar. 8, 1993, pp. 142-146.

K.G. Chandrapa, et al. in "Proprietes physiques et thermiques des sables autodurcissants lies au silicate de soude," published in Fonderie, Fondeur D'Aujourd'Hui, Editions Techniques Des Industries de la Fonderie, Sevres, FR, vol. 83, Mar. 1, 1989, pp. 25-34.

P. Lemon in "Modern sand binders—a review," published in Foundry Trade Journal, Institute of Cast Metals Engineers, West Bromwich, GB, vol. 163, No. 3403, Dec. 8, 1989, pp. 922-926.

Japanese Office Action Notification of Reasons for Rejection dated Oct. 8, 2013 corresponding to Japanese Patent Application No. 2010-530359.

The Foseco Foundryman's Handbook, 10th Edition 1994, revised and edited by John R. Brown.

Datasheet for Wedron Silica Sand, Fairmount Santrol (new, Jul. 2017).

Datasheet for Wedron Silica Sand, Fairmount Minerals (old, May 2004).

Datasheet for Wedron Silica Sand, Fairmount Minerals (old, Apr. 2002).

Information Sheet for Congleton HST 60.

VDG Information Sheet on "Chromite Sand," May 1979.

Zircon Product Datasheet, GmD—Mineral Trade Company, Apr. 2014.

Opposition to Patent EP 2,209,572 B1, "Molding Material Mixture Having Improved Flowability," Patent Owner: ASK Chemicals GmbH, Opponent: Peak International Products B.V. (Sep. 13, 2017).

Opposition to Patent EP 2,209,572, "Molding Material Mixture Having Improved Flowability," Patent Owner: ASK Chemicals GmbH, Opponent: Thomas Steinhäuser (Aug. 31, 2017).

* cited by examiner

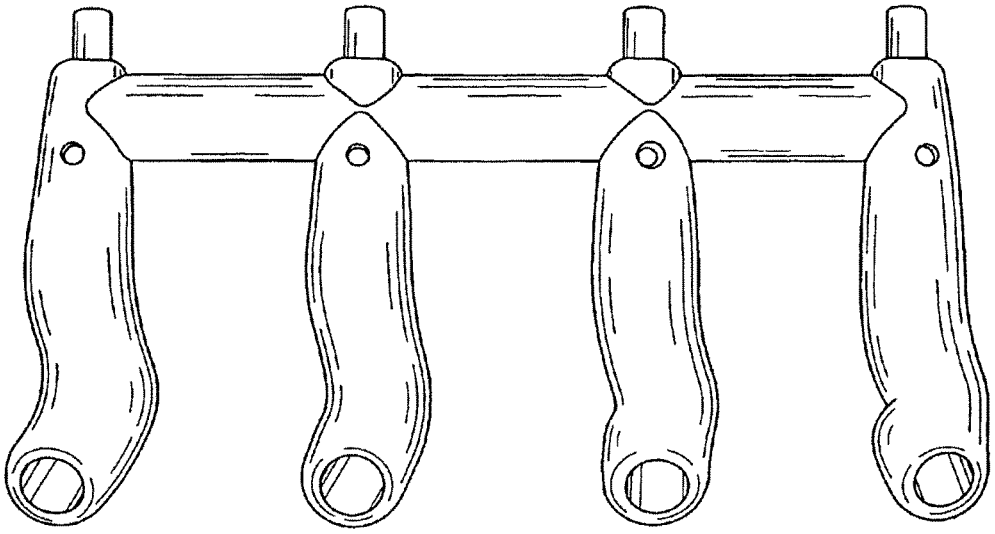

MOULD MATERIAL MIXTURE HAVING IMPROVED FLOWABILITY

This application is divisional application of U.S. application Ser. No. 12/740,859, which has a 371(c) filing date Sep. 16, 2010 and is a national phase entry under 35 USC § 371 of International Application Number PCT/EP2008/009177, filed on Oct. 30, 2008, entitled "MOULD MATERIAL MIXTURE HAVING IMPROVED FLOWABILITY", which claims the benefit of German Patent Application Number DE 10 2007 051 850.3, filed Oct. 30, 2007, all of which are incorporated by reference.

The invention relates to a mould material mixture for producing casting moulds for metal processing, including at least one fire-resistant base moulding material, a binder based on water glass, and a proportion of a particulate metal oxide selected from the group consisting of silicon dioxide, aluminium oxide, titanium oxide, and zinc oxide. The invention further relates to a process for producing casting moulds for metal processing using the mould material mixture, and a casting form obtained by the process.

Casting forms for producing metal objects are essentially produced in two designs. A first group includes cores or moulds. From these, the casting mould that essentially represents the negative form of the cast item to be produced is put together. A second group includes hollow bodies, also known as feeder heads, which function as compensation reservoirs. These hold molten metal, and by the implementation of appropriate measures it is possible to ensure that the metal remains in the molten phase for longer than the metal in the negative form casting mould. As the metal in the negative form solidifies, molten metal can be added from the compensation reservoir to compensate for the volume contraction that occurs as the metal solidifies.

Casting moulds consist of a refractory material, for example silica sand, the grains of which are bound by a suitable binder to lend the casting form sufficient mechanical strength after the casting form has been moulded. Accordingly, casting moulds are produced using a refractory base moulding material that has been treated with a suitable binder. The refractory base moulding material is preferably in free flowing form, so that it is able to be poured into a suitable hollow form and compacted therein. The binder creates a solid bond between the particles of the base moulding material, which in turn lends the casting mould the necessary mechanical stability.

Casting moulds must satisfy a range of requirements. During the actual casting process, they must first be sufficiently stable and heat resistant to hold the molten metal that is poured into a hollow pattern formed by one or more casting mould (parts). After the solidification process starts, the mechanical stability of the casting mould is assured by a solidified layer of metal that forms along the walls of the hollow pattern. The material of the casting mould must now disintegrate under the effect of the heat given off by the metal in such manner that is loses its mechanical strength, that is to say, the bond between individual particles of the refractory material is removed. This is achieved for example by ensuring that the binder decomposes under the effect of the heat. After cooling, the solidified cast part is shaken, and ideally this causes the material of the casting moulds to crumble into a fine sand, which can be poured out of the cavities of the metal mould.

In order to produce the casting moulds, both organic and inorganic binders can be used, and can be cured either by cold or hot processes. In this context, cold processes are considered to be processes that are performed essentially at room temperature, without heating the casting mould. In such cases, curing is usually effected via a chemical reaction, which is triggered for example by passing a gas as a catalyst through the mould that is to be cured. In hot processes, the mould material mixture is heated after shaping to a temperature that is high enough to drive out the solvent contained in the binder, for example, or to initiate a chemical reaction by which the binder is cured, for example by crosslinking.

In current processes for producing casting moulds, it is common to use such organic binders in which the curing reaction is accelerated by a gas-phase catalyst, or which are cured by their reaction with a gas-phase curing agent. These processes are called "cold box" processes.

One example of the production of casting moulds using organic binders is the "Ashland cold box" process. In this process, a two-component system is used. The first component consists of the solution of a polyol, usually a phenolic resin. The second component is the solution of a polyisocyanate. Accordingly, as described in U.S. Pat. No. 3,409,579 A, these two components of the polyurethane binder are caused to react by passing a gas-phase tertiary amine through the mixture of base moulding material and binding agent after the shaping process. The polyurethane binder curing reaction is a polyaddition reaction, that is to say a reaction that does not result in the splitting off of by-products such as water. Other advantages of this cold box process include good productivity, dimensional accuracy of the casting moulds, and good technical properties, such as the casting mould strength and the processing time of the base moulding material and binder mixture.

Hot curing organic methods include the hot box process, which is based on phenolic or furan resins, the warm box process, which is based on furan resins, and the Croning process, which is based on phenol-novolak resins. In both the hot box and warm box processes, liquid resins are converted to a moulding material mixture with a latent curing agent that is only activated at elevated temperatures. In the Croning process, base moulding materials such as silica, chromium ore sands, zircon sands and similar are encased at a temperature of approximately 100 to 160° C. in a phenol-novolak resin that is liquid at such temperatures. Hexamethylenetetramine is added as a reactant for the subsequent curing stage. In the hot curing technologies indicated above, shaping and curing takes place in heatable tools, which are heated to temperatures as high as 300° C.

Regardless of the curing mechanism, a common feature of all organic systems is that they are subject to thermal decomposition when the molten metal is poured into the casting form, and they can release pollutants such as benzene, toluene, xylenes, phenol, formaldehyde, and higher cracking products, some of which are unidentified. Although it has been possible to minimise these emissions by various methods, they cannot be eliminated completely when organic binding agents are used. Even hybrid inorganic/organic systems that, like the binders used in the resole-$CO_2$ process for example, contain a proportion of organic compounds, these undesirable emissions still occur when the metals are cast.

In order to avoid emission of products of decomposition during the casting operation, it is necessary to use binders that are based on inorganic materials or that contain no more than a very low proportion of organic compounds. Such binder systems have been known for a considerable time.

A first group of inorganic binders is based on the use of water glass. In these binders, water glass constitutes the essential binder component. The water glass is mixed with a base moulding material, sand for example, to form a moulding material mixture, and this moulding material mixture is shaped into a mould. After the moulding material mixture has been shaped, the water glass is cured to give the mould the desired mechanical strength. In this context, three basic processes have been developed.

According to a first process, water is extracted from the water glass by heating the mould produced from the moulding material mixture after it has been shaped. This increases the viscosity of the water glass, and a hard, glassy film is formed on the surface of the sand grains, ensuring stable binding of the grains. This process is also referred to as the "hot curing" process.

According to a second process, carbon dioxide is passed through the mould after it has been shaped. The carbon dioxide causes the sodium ions in the water glass to precipitate as sodium carbonate, which hardens the mould directly. The strongly hydrated silicon dioxide may be crosslinked further in a post-curing step. This process is also referred to as the "gas-curing" process.

Finally, according to a third process, an ester may be added to the water glass as a curing agent. Suitable esters are, for example, acetates of polyvalent alcohols, carbonates such as propylene or butylene carbonate, or lactones such as butyrolactone. In the alkaline environment of the water glass, the esters are hydrolysed, releasing the corresponding acid and causing the water glass to gel. This process is also referred to as the "self-curing" process.

In the same way, binder systems that are curable by introducing gases were developed. A system of this type is described for example in GB 782 205, in which an alkaline water glass that can be cured by the introduction of $CO_2$ is used as the binder. An exothermic feeder mass containing an alkali silicate as the binder is described in DE 199 25 167.

The use of water glass as a binder in producing moulds and cores for metal casting is described in DE 10 2004 057 669 B3. One or more poorly soluble metal salts are added to the water glass, wherein these metal salts should be so poorly soluble that they do not react with the water glass to any significant degree at room temperature. The poorly soluble metal salts may also have poor solubility in their own right. However, it is also possible to provide these metal salts with a coating so as to obtain the desired poor solubility. In the examples, calcium fluoride, a mixture of aluminium fluoride and aluminium hydroxide, also a mixture of magnesium hydroxide and aluminium hydroxide are used as poorly soluble metal salts. Surface-active or crosslinking agents may also be added to improve the flowability of the moulding material mixture that is produced from sand and the binder compound.

Binder systems have also been developed that are self-curing at room temperature. One such system, based on phosphoric acid and metal oxides, is described for example in U.S. Pat. No. 5,582,232.

A binder compound that is suitable for producing mould material mixtures for casting moulds and cores is described in WO 97/049646. This binder compound contains a silicate, a phosphate, and a catalyst selected from the group consisting of aliphatic carbonates, cyclic alkylene carbonates, aliphatic carboxylic acids, cyclic carboxylic acid esters, phosphate esters, and mixtures thereof. A polyphosphate having an ionic unit with formula $((PO_3)_nO)$, wherein n corresponds to the average chain length and is a number between 3 and 45, is used as the phosphate. The silicate:phosphate ratio with respect to the solid components may be selected in the range between 97.5:2:5 and 40:60. A surface-active material may also be added to the compound.

Another binder system, based on a combination of water glass and a water-soluble, amorphous inorganic phosphate glass, is described in U.S. Pat. No. 6,139,619. The molar ratio between the $SiO_2$ and $M_2O$ in the water glass is between 0.6 and 2,0, wherein M is selected from the group of sodium, potassium, lithium, and ammonium. According to one embodiment, the binder system may also include a surface-active material.

Finally, inorganic binder systems that are cured at elevated temperatures, for example in a hot tool, are also known. Such hot-curing binder systems are known for example from U.S. Pat. No. 5,474,606, in which a binder system consisting of alkaline water glass and aluminium silicate is described.

However, inorganic binders are also associated with certain disadvantages compared with organic binders. For example, the casting moulds that are produced using water glass as the binder have relatively low strength. This causes problems particularly when the casting moulds are removed from the tool, because they can break. However, good strengths at this point in time are particularly important for the production of complicated, thin-walled shaped bodies and handling them safely. The reasons for the low strengths is first and foremost that the casting moulds still contain residual water from the binder. Longer residence times in the hot closed tool help to only a limited extent, since the water vapour cannot escape to a sufficient extent. To achieve very complete drying of the casting moulds, WO 98/06522 proposes leaving the moulding mixture after demoulding in a heated core box only until a dimensionally stable and load-bearing shell around the outside is formed. After opening of the core box, the mould is taken out and subsequently dried completely under the action of microwaves. However, the additional drying is complicated, increases the production time of the casting moulds and contributes considerably, not least because of the energy costs, to making the production process more expensive.

In order to ensure flowability of a refractory base moulding material based on a water glass binder, it is necessary to use relatively large quantities of water glass. However, this limits the refractory properties of the casting mould and results in poor breakdown behaviour after the casting operation. Consequently, only a small fraction of the mould sand used can be returned to the process for producing subsequent casting moulds.

In DE 29 09 107 A, a process is described for producing casting moulds from particulate and/or fibrous material with sodium silicate or potassium silicate as the binder, wherein a surface-active material, preferably a surfactant, silicone oil or a silicone emulsion is added.

A binder compound for binding sand for example is described in WO 95/15229. Such a binder compound may be used for producing cores and moulds. The binder compound includes a mixture of an aqueous solution of an alkaline metal silicate, in other words water glass with a water-soluble surface-active compound. Use of this binder compound results in improved flowability of the mould material mixture.

EP 1 095 719 A2 describes a binder system based on water glass. The binder system comprises water glass and a hygroscopic base, also an emulsion solution containing 8 to 10% silicone oil relative to the quantity of binder, the silicone oil having a boiling point of 250° C. The silicone emulsion is added in order to control the hygroscopic properties and to improve the flowability of the mould material mixture.

U.S. Pat. No. 5,711,792 describes a binder compound for the production of casting moulds that includes an inorganic binder consisting of a aqueous solution containing polyphosphate chains and/or borate ions and a water-soluble surface-active compound. The flowability of the mould material mixture is increased by the addition of the water-soluble surface-active compound.

A further weak point of the inorganic binders known hitherto is that the casting moulds produced therewith have a low stability toward high atmospheric moisture. Storage of the shaped bodies for a relatively long period of time, as is customary in the case of organic binders, is therefore not reliably possible.

Casting moulds that are produced using water glass as the binder often decompose poorly after the metal casting. Particularly when the water glass has been cured by treatment with carbon dioxide, the binder may vitrify due to the effect of the hot metal, with the result that the casting form becomes very hard and is very difficult to separate from the cast part. Attempts have therefore been made to add organic components to the mould material mixture that are burned off by the heat of the metal, thus forming pores that help to break down the casting mould after casting.

Sand mixtures for cores and moulds containing sodium silicate as the binder are described in DE 2 059 538. In order to improve the decomposition of the casting mould after the metal has been cast, glucose syrup is added to the mixture. Having been shaped in the form of a casting mould, the mould sand mixture is cured by passing carbon dioxide gas through it. The moulding sand mixture contains 1 to 3% by weight glucose syrup, 2 to 7% by weight of an alkali silicate, and a sufficient quantity of a core or mould sand. In the examples, it was found that the decomposition properties of moulds and cores containing glucose syrup are far superior to those of moulds and cores that contain sucrose or pure dextrose.

WO 2006/024540 A2 includes a description of a mould material mixture for producing casting moulds for metal working that includes at least one refractory base moulding material and a binder based on water glass. A proportion of a particulate metal oxide selected from the group consisting of silicon dioxide, aluminium oxide, titanium oxide, and zinc oxide is added to the binder. Silicic acid precipitates or pyrogenic silicic acid are particularly preferred for use as the particulate metal oxide. The particulate metal oxide, particularly silicon dioxide, causes the casting mould to break down very easily after the metal is cast, and correspondingly less effort is required to remove the casting mould.

However, the addition of the particulate metal oxide to the mould material mixture worsens the mixture's flowability, making it difficult to fill the pattern evenly and thus also to achieve even compacting in the casting mould when the casting mould is produced. In the worst case, this may even give rise to areas in the casting mould where the moulding material mixture is not compacted at all. These flawed zones are transferred to the cast item, which is rendered unusable. Uneven compacting of the moulding material mixture also makes the casting mould more brittle. As a result, it is more difficult to automate the casting process, because it is the casting moulds are more prone to damage while they are being transported. Accordingly, a proportion of a plate-like lubricant such as graphite, mica or talcum is preferably added to the refractory base moulding material, so that friction between individual sand grains is reduced and more complex casting moulds can also be produced without more serious difficulties.

However, as core geometries become more and more complex, the flowability of the mould material mixture is also subject to increasingly stringent requirements. Whereas these problems were solved by the use of organic binders in the past, since the successful introduction of inorganic binding agents into large scale production, foundries are also expressing the desire that inorganic binders and refractory moulding material mixtures also be made available for extremely complex casting moulds. At the same time it must be ensured that cores with such complex geometries can also be mass-produced industrially. In other words, it must be possible to produce the cores reliably in short process cycles, and the cores must be strong enough at all phases of production so that they can be manufactured in automated production processes without sustaining damage, particularly in the thin-walled areas of the core. The strength of the cores must be guaranteed during all steps of the production process, even if the properties of the moulding sand vary. New sand is not always used for manufacturing cores. On the contrary, the mould sand is reconditioned after a casting, and the regenerated material is used again to produce moulds and cores. When the mould sand is regenerated, most of the binder remaining on the surface of the sand grains is stripped off again. This may be carried out mechanically, for example, by shaking the sand so that the grains rub against each other. The sand is then dedusted and reused. However, it is usually not possible to remove the binder layer completely. Furthermore, the sand grains can be damaged by the mechanical process, so ultimately a compromise must be struck between the requirement to remove as much of the binder as possible and the requirement not to damage the sand grains. Consequently, it is not normally possible to restore the properties of new sand when regenerating mould sand for reuse. Most often, regenerated sand has a rougher surface than new sand. This not only has implications for production, it also affects the flow properties of a mould material mixture that is produced from regenerated sand.

The object underlying the invention was therefore to provide a mould material mixture for producing casting moulds for metal processing that includes at least one refractory base moulding material and a binder based on water glass, wherein the mould material mixture contains a proportion of a particulate metal oxide selected from the group consisting of silicon dioxide, aluminium oxide, titanium oxide, and zinc oxide, which enables production of casting moulds with highly complex geometry and possibly also including thin-walled sections, for example.

This object is solved with a mould material mixture having the features of claim 1. Advantageous embodiments of the mould material mixture according to the invention are described in the dependent claims.

The flowability of the mould material mixture may be significantly improved by adding at least one surface-active substance. A considerably higher density is obtained when producing casting moulds, that is to say the particles of the refractory base moulding material are packed considerably more densely. This in turn increases the stability of the casting mould, and weak points that impair the quality of the casting profile may be reduced substantially, even in geometrically demanding sections of the casting mould. A further advantage of using the mould material mixture according to the invention for producing casting moulds consists in that the mechanical stress on the moulding tools is reduced substantially. Die abrasive effect of the sand on the tools is minimised, thereby reducing maintenance effort. Due to the greater flowability of the mould material mixture, the shooting pressures on the core blowing machines may also be reduced without the need to sacrifice core compacting quality.

Surprisingly, the heat stability of the core was also improved by adding the surface-active material. After a core has been manufactured, it may be demoulded quickly, thus enabling short production cycles. This is also possible for cores that include thin-walled sections, that is to say cores that are sensitive to mechanical stress.

The mould material mixture material according to the invention is preferably cured after shaping by extracting the water and initiating a polycondensation reaction. Surprisingly, the surface-active material does not negatively affect the heat stability of a mould that has been produced from the mould material mixture, although the surface-active material was expected to interfere with structure formation in the glassy film, and thus rather impair the mould's thermal stability.

The mould material mixture of the invention for producing casting moulds for metalworking comprises at least:

- a refractory base moulding material;
- a binder based on water glass;
- a proportion of a particulate metal oxide, selected from the group consisting of silicon dioxide, aluminium oxide, titanium oxide, and zinc oxide;

according to the invention, a proportion of at least one surface-active material is added to the mould material mixture.

As refractory base moulding material, it is possible to use materials customary for producing casting moulds. Suitable materials are, for example, silica sand or zircon sand. Fibrous refractory base moulding materials such as chamotte fibres are also suitable. Other suitable refractory base moulding materials are, for example, olivine, chromium ore sand, vermiculite.

Further materials which can be used as refractory base moulding materials are synthetic moulding materials such as hollow aluminium silicate spheres (known as microspheres), glass beads, glass granules or spherical ceramic base moulding materials known under the trade name "Cerabeads®" or "Carboaccucast®". These spherical ceramic base moulding materials contain, for example, mullite, α-alumina, β-cristobalite in various proportions as minerals. They contain aluminium oxide and silicon dioxide as significant components. Typical compositions contain, for example, $Al_2O_3$ and $SiO_2$ in approximately equal proportions. In addition, further constituents may also be present in proportions of <10%, such as $TiO_2$, $Fe_2O_3$. The diameter of the microspheres is preferably less than 1000 μm, particularly less than 600 μm. Synthetically produced refractory base moulding materials such as mullite (x $Al_2O_3$. y SiO2, where x=2 to 3, y=1 to 2; ideal formula: $Al_2SiO_5$) are also suitable. These synthetic refractory base moulding materials are not derived from a natural source and may also have been subjected to a special shaping process, as, for example, in the production of hollow aluminium silicate microspheres, glass beads or spherical ceramic base moulding materials.

According to one embodiment, glass materials are used as refractory base moulding materials. These are, in particular, used either in the form of glass spheres or as glass granules. As glass, it is possible to use conventional glasses, preferably glasses having a which have a high melting point. It is possible to use, for example, glass beads and/or glass granules produced from crushed glass. Borate glasses are likewise suitable. The composition of such glasses is indicated by way of example in the following table.

TABLE

Composition of glasses

| Constituent | Crushed glass | Borate glass |
|---|---|---|
| $SiO_2$ | 50-80% | 50-80% |
| $Al_2O_3$ | 0-15% | 0-15% |
| $Fe_2O_3$ | <2% | <2% |
| $M^{II}O$ | 0-25% | 0-25% |
| $M^{I}_2O$ | 5-25% | 1-10% |
| $B_2O_3$ | | <15% |
| Others | <10% | <10% |

$M^{II}$: Alkaline earth metal, e.g. Mg, Ca, Ba
$M^{I}$: Alkali metal, e.g. Na, K However, apart from the glasses given in the table, it is also possible to use other glasses whose contents of the abovementioned compounds are outside the ranges given. Likewise, it is also possible to use speciality glasses which contain other elements or oxides thereof in addition to the oxides mentioned.

The diameter of the glass spheres is preferably 1 to 1000 μm, particularly 5 to 500 μm, and especially 10 to 400 μm.

In casting experiments using aluminium, it has been found that when synthetic base moulding materials, especially glass beads, glass granules or microspheres, are used, less mould sand remains adhering to the metal surface after casting than when pure silica sand is used. The use of synthetic base moulding materials therefore makes it possible to produce smoother cast surfaces, in which complicated after-working by blasting is necessary to a significantly reduced extent, if at all.

It is not necessary for the entire base moulding material to be made up of the synthetic base moulding materials. The preferred proportion of synthetic base moulding materials is at least about 3% by weight, particularly at least 5% by weight, especially at least 10% by weight, preferably at least about 15% by weight, particularly preferably at least about 20% by weight, relative to the total quantity of base moulding material. The refractory base moulding material is preferably capable of powder flow so that the moulding material mixture according to the invention may be processed in conventional core shooting machines.

As a further component, the moulding material mixture of the invention comprises a binder based on water glass. As water glass, it is possible to use conventional water glasses such as have already been used as binders in moulding material mixtures. These water glasses comprise dissolved sodium or potassium silicates and may be prepared by dissolving vitreous potassium and sodium silicates in water. The water glass preferably has an $SiO_2/M_2O$ ratio in the range from 1.6 to 4.0, particularly from 2.0 to 3.5, where M stands for sodium and/or potassium. The water glasses preferably have a solids content in the range from 30 to 60% by weight. The solids content is relative to the quantity of $SiO_2$ and $M_2O$ present in the water glass. The binder based on water glass may contain other components besides water glass that have a binding effect. However, it is preferred to use pure water glass as the binder. The solids content of water glass consists preferably of more than 80% by weight, more preferably at least 90% by weight, particularly preferably at least 95% by weight, and according to a further embodiment at least 98% by weight alkali silicates. If the binder contains phosphates, the proportion thereof, calculated as $P_2O_5$ and relative to the solids content of the water glass, is preferably less than 10% by weight, more preferably less than 5% by weight, and according to another embodiment less than 2% by weight. According to one embodiment, the binder contains no phosphate.

The mould material mixture also contains a proportion of a particulate metal oxide selected from the group consisting of silicon dioxide, aluminium oxide, titanium oxide, and zinc oxide. The average primary particle size of the particulate metal oxide may preferably be between 0.10 μm and 1 μm. However, due to agglomeration of the primary particles, the particle size of the metal oxides is preferably less than 300 μm, particularly less than 200 μm, especially less than 100 μm. According to one embodiment, the particle size is more than 5 μm, according to another embodiment it is more than 10 μm, according to another embodiment, more than 15 μm. The average particle size is preferably in the range from 5 to 90 μm, particularly preferably 10 to 80 μm, and especially preferably in the range from 15 to 50 μm. The particle size may be determined for example by sieve analysis. It is particularly preferable if the residue on a sieve having a mesh size of 63 μm is less than 10% by weight, preferably less than 8% by weight.

It is particularly preferable if silicon dioxide is used as the particulate metal oxide, and in this case, synthetically manufactured amorphous silicon dioxide is particularly preferred.

Particulate silicon dioxide cannot be equated with the refractory base moulding material. For example, if silica sand is used as the refractory base moulding material, silica sand cannot also fulfil the function of the particulate silicon dioxide. Silica sand has a very well defined reflection in an X-ray diffraction pattern, whereas amorphous silicon dioxide has a low crystallinity, and accordingly has a considerably wider reflection.

Silicic acid precipitates or pyrogenic silicic acid are preferably used as the particulate silicon dioxide. These silicic acids may thus be used in a mixture as well. Silicic acid precipitates are obtained by reacting an aqueous solution of alkali silicate with mineral acids. The precipitate obtained is subsequently separated off, dried and milled. The term pyrogenic silicas refers to silicas which are obtained by coagulation from the gas phase at high temperatures. Pyrogenic silica may be produced, for example, by flame hydrolysis of silicon tetrachloride or in an electric arc furnace by reduction of silica sand by means of coke or anthracite to form silicon monoxide gas followed by oxidation to silicon dioxide. The pyrogenic silicas produced by the electric arc furnace process may still contain carbon. Precipitated silica and pyrogenic silica are equally suitable for the moulding mixture of the invention. These silicas will hereinafter be referred to as "synthetic amorphous silicon dioxide".

Pyrogenic silicic acid is characterized by a very large specific surface area. The particulate silicon dioxide thus preferably has a specific surface area of more than 10 $m^2/g$, according to another embodiment more than 15 $m^2/g$. According to one embodiment, the particulate silicon dioxide has a specific surface area of less than 40 $m^2/g$, according to another embodiment less than 30 $m^2/g$. The specific surface area may be determined by nitrogen adsorption in accordance with DIN 66131.

According to one embodiment, the amorphous, uncompacted particulate silicon dioxide has a bulk density of more than 100 $m^3/kg$, according to another embodiment more than 150 $m^3/kg$. According to one embodiment, the amorphous, uncompacted particulate silicon dioxide has a bulk density of less than 500 $m^2/g$, according to another embodiment a bulk density of less than 400 $m^2/g$.

The inventors assume that the strongly alkaline water glass is able to react with the silanol groups present on the surface of the synthetic amorphous silicon dioxide and that evaporation of the water results in formation of a strong bond between the silicon dioxide and the then solid water glass.

A further essential component of the mould material mixture according to the invention is a surface-active substance. For the purposes of the invention, a surface-active substance is a substance that is able to form a monomolecular layer on an aqueous surface, that is to say is capable of forming a membrane, for example. Additionally, a surface-active substance reduces the surface tension of water. Suitable surface-active substances are for example silicone oils.

The surface-active substance is particularly preferably a surfactant. Surfactants include a hydrophilic part and a hydrophobic part, the properties of which are balanced such that in an aqueous phase the surfactants form micelles, for example, or are able to accumulate at the interface.

In principle, all classes of surfactants may be used in the mould material mixture according to the invention. Besides anionic surfactants, non-ionic, cationic, and amphoteric surfactants are also suitable. For exemplary purposes, non-ionic surfactants include for example ethoxylated or propoxylated long-chain alcohols, amines or acids such as fatty alcohol ethoxylates, alkylphenol ethoxylates, fatty amine ethoxylates, fatty acid ethoxylates, the corresponding propoxylates, or also sugar surfactants, for example fatty alcohol-based polyglycosides. The fatty alcohols preferably include 8 to 20 carbon atoms. Suitable cationic surfactants are alkyl ammonium compounds and imidazolinium compounds.

Use of anionic surfactants is preferred for the mould material mixture according to the invention. The anionic surfactant preferably contains a sulphate, sulphonate, phosphate, or carboxylate group as the polar hydrophilic group, wherein sulphate and phosphate groups are particularly preferred. If anionic surfactants containing sulphate groups are used, particular preference is given to using sulphuric acid monoesters. If phosphate groups are used as the polar anionic surfactant group, the mono- and diesters of orthophosphoric acid are particularly preferred.

The common property of all surfactants used in the mould material mixture according to the invention is that the non-polar, hydrophobic portion is preferably constituted by alkyl, aryl, and/or aralkyl groups, preferably having more than 6 carbon atoms, particularly preferably having 8 to 20 carbon atoms. The hydrophobic portion may have both linear chains and branched structures. Mixtures of various surfactants may also be used.

Particularly preferred anionic surfactants are selected from the group consisting of oleyl sulphate, stearyl sulphate, palmityl sulphate, myristyl sulphate, lauryl sulphate, decyl sulphate, octyl sulphate, 2-ethylhexyl sulphate, 2-ethyloctyl sulphate, 2-ethyldecyl sulphate, palmitoleyl sulphate, linolyl sulphate, lauryl sulphonate, 2-ethyldecyl sulphonate, palmityl sulphonate, stearyl sulphonate, 2-ethylstearyl sulphonate, linolyl sulphonate, hexyl phosphate, 2-ethylhexyl phosphate, capryl phosphate, lauryl phosphate, myristyl phosphate, palmityl phosphate, palmitoleyl phosphate, oleyl phosphate, stearyl phosphate, poly-(1,2-ethanediyl-)-phenol hydroxyphosphate, poly-(1, 2-ethanediyl-)-stearyl phosphate, and poly-(1,2-ethanediyl-)-oleyl phosphate.

In the mould material mixture according to the invention, the pure surface-active substance is preferably contained in a ratio of 0.001 to 1% by weight, particularly 0.01 to 0.5% by weight relative to the weight of the refractory base moulding material. Such surface-active substances are widely available commercially in 20% to 80% solutions. In this case, the aqueous solutions of the surface-active substances are preferred.

In principle, the surface-active substance may be added to the mould material mixture in the dissolved form, in the binder for example, as a separate component, or also via a solid-phase component. The surface-active substance is particularly preferably dissolved in the binder.

According to a preferred embodiment, at least a part of the refractory base moulding material comprises a regenerated refractory base moulding material. In this context, a regenerated refractory base moulding material is understood to be a refractory base moulding material that has already been used to produce casting moulds at least once and has been reconditioned afterwards so that it may be returned to the process of producing casting moulds.

The improved flowability observed for the mould material mixture according to the invention is particularly important if the mould material mixture contains some fraction of a regenerated refractory base moulding material, of a silica sand for example, instead of a pure refractory base moulding material, for example a pure silica sand. Regardless of the type of regeneration applied, regenerated refractory base moulding materials still include binder residues, which are very difficult to remove entirely from the grain surface. These residues lend the regenerated material a "dull character" and inhibit the flowability of the mould material mixture. Consequently, it is often not possible to produce complicated moulds in practice except with new sand. However, the flowability of the mould material mixture according to the invention is good enough to enable the production of cores having very complicated geometry even when the mould material mixture is constituted in part from regenerated refractory base moulding material. Surprisingly, it was found in this context that moulds produced using regenerated refractory base moulding material also have good structural strength, particularly hot strength. This strength is considerably greater than for moulds that have been produced using a mould material mixture containing water glass as the binder in addition to the refractory base moulding material and a finely particulate amorphous silicon dioxide, but not a surface-active material, particularly not a surfactant.

In general all refractory base moulding materials may be the subject of regeneration, for example all of the refractory base moulding materials listed above. In principle, there are also no limitations on the binder with which the refractory base moulding material is contaminated before regeneration. Either organic or inorganic binders may have been used in the preceding use of the refractory base moulding material. Thus, mixtures of various used refractory base moulding materials may have been used for the regeneration just as well as pure types of refractory base moulding materials. The regenerated refractory base moulding materials used are preferably materials that have been produced from a single type of used refractory base moulding material, wherein the used refractory base moulding materials still includes residues of a preferably inorganic binder, particularly preferably a binder prepared from a water glass base.

In principle, any processes may be implemented for regenerating the refractory base moulding material. For example, the used refractory base moulding material may be regenerated mechanically, in which case the binder residues or products of decomposition remaining on the used refractory base moulding material after casting are removed by rubbing. For this, the sand may be shaken violently, for example, so that the sand grains collide with those around them and the binder residues are knocked off by the impact. The binder residues may then be separated from the regenerated refractory base moulding material by sieving and dedusting. If required, the used refractory base moulding material may also be thermally pre-treated to render the film of binder on the grains brittle, making it easier to rub off. Particularly if the used refractory base moulding material still contains residues of water glass as the binder, regeneration may take the form of washing the used refractory base moulding material with water.

The used refractory base moulding materials may also be regenerated by heating. Regeneration of this kind is common for example when the used refractory base moulding materials are contaminated with residues of organic binders. When air is introduced, these organic binder residues are burned off. This process may be preceded by mechanical precleaning, so that some of the binder residue has already been removed.

Particularly preferred is regenerated refractory base moulding material obtained from a used refractory base moulding material contaminated with water glass, wherein the used refractory base moulding material has been thermally regenerated. In a regeneration process of this kind, a used refractory base moulding material coated with a binder based on water glass is provided. The used foundry sand then undergoes heat treatment in which the used refractory base moulding material is heated to a temperature of at least 200° C.

A method of this kind is described for example in WO 2008/101668 A1.

In principle, the refractory base moulding material used in the mould material mixture may include any proportion of regenerated refractory base moulding material. The refractory base moulding material may consist entirely of regenerated refractory base moulding material. However, it is also possible for the refractory base moulding material to include only small proportions of the regenerated material. For example, the proportion of regenerated refractory base moulding material may be between 10 and 90% by weight, according to another embodiment between 20 and 80% by weight relative to the refractory base moulding material included in the mould material mixture. However, larger and smaller proportions are also possible.

According to one embodiment, at least one carbohydrate is added to the mould material mixture according to the invention. When carbohydrates are added to the mould material mixture, it is possible to produce casting moulds based on an inorganic binder that retain high strength not only immediately after they are produced but also after storage for prolonged periods. Moreover, the metal casting yields a cast item having very good surface quality, and very little postprocessing is required on the surface of the cast item after demoulding. Higher molecular oligo- and even polysaccharides may be used as the carbohydrates as well as mono- or disaccharides. Carbohydrates of a single composition may be used as well as a mixture of various carbohydrates. The purity of the carbohydrates used is not subject to excessively stringent requirements. It is sufficient if the carbohydrates are provided with a purity of more than 80% by weight, particularly more than 90% by weight, and especially more than 95% by weight relative to the their dry weight in each case. In principle, the monosaccharide units of the carbohydrates may be linked in any way. The carbohydrates preferably have a linear structure, for example an $\alpha$ or $\beta$ 1,4 glycosidic bond. However, the carbohydrates may also be partially or entirely 1,6 linked, such as for example amylopectin, which has up to 6% $\alpha$-1,6-bonds.

In principle, even a relatively small quantity of carbohydrate is able to have a marked effect on the strength of the casting moulds before casting and improve surface quality noticeably. The proportion of carbohydrate relative to the refractory base moulding material is selected preferably in the range from 0.01 to 10% by weight, particularly 0.02 to 5% by weight, especially 0.05 to 2.5% by weight, and most preferably in the range from 0.1 to 0.5% by weight. Even small proportions of carbohydrates in the range of about 0.1% by weight have significant effects.

According to another embodiment, the carbohydrate may be present in the mould material mixture in non-derivatised form. Carbohydrates of such kind may be obtained inexpensively from natural sources such as plants, for example from cereals or potatoes. The molecular weight of such carbohydrates from natural sources may be lowered for example by chemical or enzymatic hydrolysis, in order to improve their solubility in water, for example. Besides non-derivatised carbohydrates, which consist solely of carbon, oxygen and hydrogen, derivatised carbohydrates may also be used, in which for example some or all of the hydroxy groups are etherified with alkyl groups, for example. Suitable derivatised carbohydrates are for example ethyl cellulose or carboxymethyl cellulose.

In principle, carbohydrates with low molecular weight, such as mono- and disaccharides, may also be used. Examples thereof are glucose or sucrose. However, the advantageous effects are observed particularly when oligo- or polysaccharides are used. Accordingly, an oligosaccharide or polysaccharide is particularly preferred as the carbohydrate.

In this context, it is preferable that the oligo- or polysaccharide has a molar mass in the range from 1,000 to 100,000 g/mol, preferably in the range from 2,000 to 30,000 g/mol. A marked increase in the strength of the casting mould is observed when the carbohydrate has a molar mass in the range from 5,000 to 20,000 g/mol, with the result that the casting mould may be removed from the mould and transported easily during production. The casting mould also demonstrates very good strength when stored for extended periods, so there are no problems associated with storing the casting moulds even for several days and with exposure to atmospheric moisture, as is essential for volume production of cast items. Resistance to the effects of water, such as is unavoidable when a sizing coat is applied to the casting mould, for example, is also very good.

The polysaccharide preferably consists of glucose units, which preferably have α or β 1,4 glycosidic bonds. However, it is also possible to use carbohydrate compounds containing other monosaccharides as well as glucose, for example galactose or fructose, as the additive according to the invention. Examples of suitable carbohydrates are lactose (α or β 1,4 linked disaccharide from galactose and glucose) and sucrose (disaccharide from α-glucose and β-fructose).

The carbohydrate is particularly preferably selected from the group consisting of cellulose, starch, and dextrins as well as derivatives of such carbohydrates. Suitable derivatives are for example derivatives that are partly or completely etherified with alkyl groups. However, other derivatisations may also be performed, for example esterifications with inorganic or organic acids.

The stability of the casting moulds and of the surface of the cast item may be further optimised if special carbohydrates, and in this context starches, dextrins (products of the hydrolysis of starches) and derivatives thereof are particularly preferred, are used as an additive to the mould material mixture. In this context, naturally occurring starches such as the starch in potatoes, corn, rice, peas, bananas, horse chestnuts or wheat lend themselves particularly to use as starches. However, it is also possible to use modified starches such as pregelatinised starch, thin-boiling starch, oxidised starch, citrate starch, acetate starch, starch ether, starch esters, or also starch phosphates. In principle, there are no limitations regarding the choice of starch. For example, the starch may have a low, medium or high viscosity, it may be cationic or anionic, or soluble in cold or hot water. Dextrin from the group consisting of potato dextrin, corn dextrin, yellow dextrin, white dextrin, borax dextrin, cyclodextrin and maltodextrin is particularly preferred.

The mould material mixture preferably includes a compound that contains phosphate, particularly when casting moulds with very thin sections are being produced. In this context, either organic or inorganic phosphorus compounds may be used. In order to avoid causing any undesirable side reactions during metal casting, it is further preferred that the phosphorus in the phosphorus-containing compounds is preferably present in oxidation state V. The addition of compounds containing phosphorus may further increase the stability of the casting mould. This is particularly important when the molten metal encounters a curved surface during casting, because the high metallostatic pressure created thereby has a strongly eroding effect and may lead to deformations particularly of thin-walled sections of the casting mould.

In this context, the phosphorus-containing compound is preferably present in the form of a phosphate or phosphorus oxide. The phosphate may be an alkali or alkaline earth metal phosphate, wherein the sodium salts are particularly preferred. In principle, ammonium phosphates or phosphates of other metal ions may be used. However, the alkali or alkaline earth metal phosphates that are considered preferred are readily available and may be obtained inexpensively in any quantity.

If the phosphorus-containing compound is added to the mould material mixture in the form of a phosphorus oxide, the phosphorus oxide is preferably phosphorus pentoxide. However, phosphorus trioxide and phosphorus tetroxide are also usable.

According to a further embodiment, the phosphorus-containing compound may be added to the mould material mixture in the form of salts of fluorophosphoric acids. In this case, the salts of monofluorophosphoric acid are particularly preferred. The sodium salt is especially preferred.

According to a preferred embodiment, the phosphorus-containing compound is added to the mould material mixture in the form of organic phosphates. In this case, alkyl or aryl phosphates are preferred. In this context, the alkyl groups preferably contain 1 to 10 carbon atoms and may be straight chain or branched. The aryl groups preferably include 6 to 18 carbon atoms, wherein the aryl groups may also be substituted by alkyl groups. Phosphate compounds derived from monomeric or polymeric carbohydrates, such as glucose, cellulose or starch, are particularly preferred. Use of an organic phosphorus-containing component as an additive has two main advantages. Firstly, the phosphorus part is able to lend the casting mould the required thermal stability, and secondly, the surface quality of the corresponding cast part is improved by the organic part.

Orthophosphates as well as polyphosphates, pyrophosphates or metaphosphates may be used as phosphates. The phosphates may be prepared for example by neutralising the corresponding acids with a corresponding base, for example an alkali metal or alkaline earth base such as NaOH, wherein not all negative charges of the phosphate ion necessarily have to be saturated with metal ions. Metal hydrogen and metal dihydrogen phosphates may be used as well as metal phosphates, including for example $Na_3PO_4$, $Na_2HPO_4$ and $NaH_2PO_4$. Equally, both anhydrous phosphates and phosphate hydrates may be used. The phosphates may be introduced into the mould material mixture in either the crystalline or amorphous form.

Polyphosphates are particularly understood to refer to linear phosphates having more than one phosphorus atom, wherein the each of the phosphorus atoms is bonded by an oxygen bridge. Polyphosphates are obtained by dehydrocondensation of orthophosphate ions to yield a linear chain of $PO_4$ tetrahedra, each of which is linked at the corners. Polyphosphates have general formula $(0(PO_3)_n)^{(n+2)-}$, where n corresponds to the chain length. A polyphosphate can consist of as many as several hundred $PO_4$ tetrahedra. Polyphosphates with shorter chain lengths are preferred, however. It is preferable if n represents values from 2 to 100, particularly 5 to 50. It is also possible to use more highly condensed polyphosphates, that is to say polyphosphates in which the $PO_4$ tetrahedra are linked to each other at more than two corners and thereby manifest polymerisation in two or three dimensions.

Metaphosphates are understood to refer to cyclic structures that are formed from $PO_4$ tetrahedra, each of which is linked at its corners. Metaphosphates have general formula $((PO_3)_n)^{n-}$, wherein n is at least 3. Preferably, n represents values from 3 to 10.

Both individual phosphates and mixtures of various phosphates and/or phosphorus oxides may be used.

The preferred proportion of the phosphorus-containing compound relative to the refractory base moulding material is between 0.05 and 1.0% by weight. If the proportion is less than 0.05% by weight, no significant effect on the dimensional stability of the casting mould is observed. If the proportion of phosphate exceeds 1.0% by weight, the thermal stability of the casting mould falls sharply. The proportion of phosphorus-containing compound is preferably selected in the range between 0.10 and 0.5% by weight. The phosphorus-containing compound preferably contains between 0.5 and 90% by weight phosphorus, calculated as $P_2O_5$. If inorganic phosphorus compounds are used, they contain preferably 40 to 90% by weight and particularly 50 to 80% by weight phosphorus, calculated as $P_2O_5$. If organic phosphorus compounds are used, they contain preferably 0.5 to 30% by weight and particularly 1 to 20% by weight phosphorus, calculated as $P_2O_5$.

In principle, the phosphorus-containing compound may be added to the mould material mixture in solid or dissolved form. The phosphorus-containing compound is preferably added to the mould material mixture in the solid form. If the phosphorus-containing compound is added in dissolved form, the preferred solvent is water.

The moulding mixture of the invention is an intimate mixture of at least the constituents mentioned. In this context, the particles of the refractory base moulding material are preferably coated with a layer of the binder. Firm cohesion between the particles of the refractory base moulding material may then be achieved by evaporation of the water present in the binder (about 40-70% by weight relative to the weight of the binder).

The binder, that is to say the water glass and the particulate metal oxide, in particular synthetic amorphous silicon dioxide and the surface-active substance, is present in the mould material mixture in a proportion of preferably less than 20% by weight, particularly less than 15% by weight. The proportion of binder then refers to the solid component of the binder. If massive refractory base moulding materials are used, for example silica sand, the binder is preferably present in a proportion of less than 10% by weight, preferably less than 8% by weight, particularly preferably less than 5% by weight. If refractory base moulding materials of a low density are used, for example the above-described hollow microspheres, the proportion of binder increases correspondingly. In order to ensure cohesion of the grains in the refractory base moulding material, the proportion of the binder is selected to be greater than 1% by weight according to one embodiment, and greater than 1.5% by weight according to another embodiment.

The ratio of water glass to particulate metal oxide, in particular synthetic amorphous silicon dioxide, may be varied within a wide range. This offers the advantage that the initial strength of the casting mould, that is to say its strength immediately after removal from the hot tool, and the moisture resistance may be improved without significantly affecting the final strengths, that is the strengths after cooling of the casting mould, compared to a water glass binder without amorphous silicon dioxide. This is particularly relevant for light metal casting. On the one hand, high initial strengths are desirable so that the casting mould may be transported or combined with other casting moulds without difficulties after production. On the other hand, the final strength after curing should not be too high in order to avoid problems with binder decomposition after casting, that is to say the base moulding material should be able to be removed without problems from cavities in the casting mould after casting.

The particulate metal oxide, in particular the synthetic amorphous silicon dioxide, is, based on the weight of the binder, preferably present in a proportion from 2 to 80% by weight, more preferably from 3 to 60% by weight, particularly preferably from 4 to 50% by weight relative to the total weight of the binder.

In one embodiment of the invention, the base moulding material present in the moulding mixture of the invention may contain at least a proportion of hollow microspheres. The diameter of the hollow microspheres is normally in the range from 5 to 500 μm, preferably in the range from 10 to 350 μm, and the thickness of the shell is usually in the range from 5 to 15% of the diameter of the microspheres. These microspheres have a very low specific weight, so that the casting moulds produced using hollow microspheres have a low weight. The insulating action of the hollow microspheres is particularly advantageous. The hollow microspheres are therefore used for producing casting moulds particularly when such moulds are to have enhanced insulating action. Such casting moulds are, for example, the feeders described in the introduction, which act as compensation reservoirs and hold liquid metal, the purpose being that the metal is maintained in a liquid state until the metal introduced into the hollow mould has solidified. Another field of application for casting moulds containing hollow microspheres is, for example, sections of a casting mould that correspond to particularly thin-walled sections of the finished casting. The insulating action of the hollow microspheres ensures that the metal does not solidify prematurely in the thin-walled sections and block the paths within the casting mould.

If hollow microspheres are used, because of the low density of these hollow microspheres, the binder is preferably used in a proportion of preferably less than 20% by weight, particularly preferably in a proportion of from 10 to 18% by weight. These values refer to the solid component of the binder.

The hollow microspheres are preferably made from an aluminium silicate. These hollow aluminium silicate microspheres preferably have an aluminium oxide content of more than 20% by weight, but may also have a content of more than 40% by weight. Such hollow microspheres are marketed, for example, by Omega Minerals Germany GmbH, Norderstedt, under the trade names Omega-Spheres® SG having an aluminium oxide content of about 28-33%, Omega-Spheres® WSG having an aluminium oxide content of about 35-39% and E-Spheres® having an aluminium oxide content of about 43%. Corresponding products can be obtained from PQ Corporation (USA) under the trade name "Extendospheres®".

According to a further embodiment, hollow microspheres made from glass are used as the refractory base moulding material.

According to a particularly preferred embodiment, the hollow microspheres comprise a borosilicate glass. The borosilicate glass has a proportion of boron, calculated as $B_2O_3$, of more than 3% by weight. The proportion of hollow microspheres is preferably less than 20% by weight relative to the moulding material mixture. When hollow borosilicate glass microspheres are used, a low proportion is preferably chosen. This is preferably less than 5% by weight, more preferably less than 3% by weight and particularly preferably in the range from 0.01 to 2% by weight.

As was indicated previously, in a preferred embodiment the mould material mixture of the invention contains at least a proportion of glass granules and/or glass beads as refractory base moulding material.

It is also possible to produce the mould material mixture as an exothermic mould material mixture which is, for example, suitable for producing exothermic feeders. For this purpose, the mould material mixture contains an oxidizable metal and a suitable oxidant. Based on the total mass of the mould material mixture, the oxidizable metals are preferably present in a proportion of from 15 to 35% by weight. The oxidant is preferably added in a proportion of from 20 to 30% by weight relative to the mould material mixture. Suitable oxidizable metals are, for example, aluminium or magnesium. Suitable oxidants are, for example, iron oxide or potassium nitrate.

According to a further embodiment, the mould material mixture of the invention may also contain a proportion of lubricants, for example platelet-like lubricants, particularly graphite, $MoS_2$, talcum and or pyrophillite, besides the surface-active substance. The quantity of the lubricant added, for example graphite, is preferably 0.05% by weight to 1% by weight relative to the base moulding material.

Apart from the abovementioned constituents, the mould material mixture of the invention may comprise further additives. For example, it is possible to add internal mould release agents which aid detachment of the casting moulds from the moulding tool. Suitable internal mould release agents are, for example, calcium stearate, fatty acid esters, waxes, natural resins or specific alkyd resins. Silanes may also be added to the mould material mixture of the invention.

Thus for example, the moulding material mixture in an embodiment of the invention contains an organic additive that has a melting point in the range from 40 to 180° C., preferably from 50 to 175° C., that is to say it is solid at room temperature. For the present purposes, organic additives are compounds whose molecular skeleton is made up predominantly of carbon atoms, for example, organic polymers. The addition of the organic additives enables the quality of the surface of the casting to be improved further. The mode of action of the organic additives has not been elucidated. However, without wishing to be tied to this theory, the inventors assume that at least part of the organic additives burns during the casting process and a creates a thin gas cushion between the liquid metal and the base material forming the wall of the casting mould, thus preventing the liquid metal from reacting with the base moulding material. The inventors further assume that part of the organic additives forms a thin layer of glossy carbon in the reducing atmosphere prevailing during casting and this likewise prevents a reaction between metal and the base moulding material. A further advantageous effect that may be achieved by adding the organic additives is an increase in the strength of the casting mould after curing.

The organic additives are preferably added in an amount of from 0.01 to 1.5% by weight, in particular from 0.05 to 1.3% by weight, particularly preferably from 0.1 to 1.0% by weight, in each case relative to the moulding material.

It has been found that an improvement in the surface of the casting may be achieved by means of very different organic additives. Suitable organic additives are, for example, phenol-formaldehyde resins such as novolaks, epoxy resins such as bisphenol A epoxy resins, bisphenol F epoxy resins or epoxidized novolaks, polyols such as polyethylene glycols or polypropylene glycols, polyolefins such as polyethylene or polypropylene, copolymers of olefins such as ethylene or propylene and further comonomers such as vinyl acetate, polyamides such as polyamide-6, polyamide-12 or polyamide-6,6, natural resins such as balsamic resin, fatty acids such as stearic acid, fatty acid esters such as cetyl palmitate, fatty acid amides such as ethylenediamine-bisstearamide and also metal soaps such as stearates or oleates of mono- to trivalent metals. The organic additives may be present either as pure substances or as a mixture of various organic compounds.

In a further embodiment, the mould material mixture of the invention contains a proportion of at least one silane. Suitable silanes are, for example, aminosilanes, epoxysilanes, mercaptosilanes, hydroxy-silanes, methacryl silanes, ureidosilanes, and polysiloxanes. Examples of suitable silanes are γ-aminopropyltrimethoxysilane, γ-hydroxypropyltrimethoxysilane, 3-ureidopropyltriethoxysilane, γ-mercaptopropyltrimethoxysilane, γ-glycidoxypropyltrimethoxysilane, β-(3,4-epoxycyclohexyl)trimethoxysilane, 3-methacryloxypropyltrimethoxysilane and N-β-(aminoethyl)-γ-aminopropyltrimethoxysilane.

Typically, the quantity of silane used is about 5-50%, preferably about 7-45%, particularly preferably about 10-40% relative to the particulate metal oxide.

Despite the high strengths that may be achieved using the binder according to the invention, the casting moulds produced using the mould material mixture of the invention, in particular cores and moulds, surprisingly display good disintegration after casting, particularly in the case of aluminium casting. However, the use of the shaped bodies produced from the mould material mixture of the invention is not restricted to light metal casting. The casting moulds are generally suitable for casting metals. Such metals are, for example, nonferrous metals such as brass or bronzes, and also ferrous metals.

The invention further relates to a process for producing casting moulds for metalworking, in which the mould material mixture of the invention is used. The process of the invention comprises the following steps:

production of the above-described mould material mixture;

moulding of the mould material mixture;

curing of the mould material mixture by heating the mould material mixture to obtain the cured casting mould.

In the general order of operations for producing the mould material mixture of the invention, first the refractory base moulding material is placed in a mixing vessel and the binder is then added while stirring.

As was described in the explanation of the mould material mixture according to the invention, at least a part of the refractory base moulding material may be constituted of regenerated, used refractory base moulding material.

It is particularly preferred when a regenerated refractory base moulding material is used that has been produced from a used refractory base moulding material and to which water glass binder residue adheres. It is further preferred when if a regenerated refractory base moulding material is used that has been produced from a used refractory base moulding material, and to which water glass binder residue adheres, and which has been regenerated thermally, wherein a method as described in WO 2008/101668 A1 is used for the regeneration. For this purpose, thermal regeneration is carried out on a used refractory base moulding material coated with a binder based on water glass, to which binder a particulate metal oxide has been added, particularly an amorphous silicon dioxide, for example pyrogenic silicic acid.

It is thus possible with the method of the invention to circulate the refractory base moulding material in the production of casting moulds and the subsequent casting of parts, wherein only portions of the refractory base moulding material, which are separated by sieving during regeneration for example, are replaced with fresh refractory base moulding material.

In principle, the water glass and the particulate metal oxide, particularly the synthetic amorphous silicon dioxide, and the surface-active substance, may be added to the refractory base moulding material in any order. The surface-active substance may be added in its native form or as a solution or emulsion, wherein the solvent used is preferably water. Aqueous emulsions or solutions of the surface-active substance are preferred. When producing the mould material mixture, it is preferable to avoid excessive foaming. This may be achieved primarily by the choice of surface-active substance. On the other hand, it is also possible to add antifoaming agents if necessary.

In principle, the additional additives described above may be added to the mould material mixture in any form. They may be added in measured quantities individually or as a mixture. They may be added in solid form, or also as solutions, pastes, or dispersions. If they are added as a solution, paste, or dispersion, the preferred solvent is water. It is also possible for the water glass which serves as the binder base to be used as the solution or dispersion medium for the additives.

In a preferred embodiment, the binder is provided in the form of a two-component system, wherein a first, liquid component contains the water glass, and a second, solid component contains the particulate metal oxide. The solid component may also contain for example the phosphate and a carbohydrate according to requirements. The surface-active substance is preferably added to the liquid component.

When the mould material mixture is produced, the refractory base moulding material is preferably placed in a mixing vessel first, then the solid component(s) of the binder is (are) added and mixed with the refractory base moulding material. The mixing time is chosen such that the refractory base moulding material and the solid binder component are mixed intimately. The mixing time depends on the quantity of the mould material mixture to be produced and the mixing unit used. The mixing time is preferably chosen between 1 and 5 minutes. The liquid component of the binder is then added, preferably while the mixture is still being agitated, and then mixing of the mixture continues until the grains of the refractory base moulding material are coated evenly with a layer of the binder. Here too, the mixing time depends on the quantity of the mould material mixture to be produced and the mixing unit used. The mixing time is preferably chosen between 1 and 5 minutes. The term liquid component is also understood to refer to both a mixture of various liquid components and the totality of all individual liquid components, wherein these last may also be added individually. In the same way, the term solid component refers both to the mixture of the solid components described above, individually or together, and the totality of all individual solid components, wherein these last may be added to the mould material mixture either together or one after the other.

In another embodiment, the liquid component of the binder may also be added to the refractory base moulding material first, then followed by the solid component. According to a further embodiment, 0.05 to 0.3% water relative to the weight of the base moulding material is added to the refractory base moulding material first, which is then followed by the solid and liquid components of the binder.

In this embodiment, a surprisingly positive effect on the processing time of the mould material mixture may be achieved. The inventors assume that the dehydrating effect of the solid binder components is thus reduced and the curing process delayed thereby.

The mould material mixture is subsequently brought to the desired shape. Conventional methods are used for moulding. For example, the moulding mixture may be shot into the moulding tool with the aid of compressed air by means of a core shooting machine. The mould material mixture is then cured by heating in order to vaporize the water present in the binder. Heating may be carried out in the moulding tool, for example. It is possible to cure the casting mould completely in the moulding tool. But it is also possible to cure only the edge region of the casting mould so that it has sufficient strength to allow it to be removed from the moulding tool. The casting mould may then be cured completely by extracting more water from it. This may be effected, for example, in an oven. Water may also be extracted for example by evaporating the water under reduced pressure.

Curing of the casting moulds may be accelerated by blowing heated air into the moulding tool. In this embodiment of the process, rapid removal of the water present in the binder is achieved, as a result of which the casting mould is strengthened within periods of time suitable for industrial use. The temperature of the air blown in is preferably from 100° C. to 180° C., particularly preferably from 120° C. to 150° C. The flow rate of the heated air is preferably set so that curing of the casting mould occurs within periods of time suitable for industrial use. The periods of time depend on the size of the casting moulds produced. The desired target time for curing is less than 5 minutes, preferably less than 2 minutes. However, in the case of very large casting moulds, longer periods of time may also be necessary.

The water may also be removed from the mould material mixture by heating the mould material mixture with microwave irradiation. However, irradiation with microwaves is preferably carried out after the casting mould has been removed from the moulding tool. But the casting mould must already be strong enough to allow this. As was explained in the preceding, this may be achieved, for example, by curing at least an outer shell of the casting mould in the moulding tool.

As was indicated previously, the mould material mixture may also contain additional organic additives. These additional organic additives may be added at any time during production of the mould material mixture. In this context, the organic additive may be added in native form or also in the form of a solution.

Water-soluble organic additives may be used in the form of an aqueous solution. If the organic additives are soluble in the binder and are stable in this without decomposition for a number of months, they may also be dissolved in the binder and thus added together with it to the base moulding material. Water-insoluble additives may be used in the form of a dispersion or paste. The dispersions or pastes preferably contain water as the dispersion medium. In principle, solutions or pastes of the organic additives may also be produced in organic solvents. However, if a solvent is used for adding the organic additives, preference is given to using water.

The organic additives are preferably added as powders or short fibres, with the mean particle size or fibre length preferably being chosen so that it does not exceed the size of the refractory base moulding material particles. The organic additives may particularly preferably pass through a sieve having a mesh size of about 0.3 mm. To reduce the number of components added to the refractory base moulding material, the particulate metal oxide and the organic additive or additives are preferably not added separately to the mould sand but are mixed beforehand.

If the mould material mixture contains silanes or siloxanes, these are usually added by incorporating them into the binder beforehand. The silanes or siloxanes may also be added to the base moulding material as a separate component. However, it is particularly advantageous to silanize the particulate metal oxide, that is to say to mix the metal oxide with the silane or siloxane, so that its surface is coated with a thin layer of silane or siloxane. When the particulate metal oxide which has been pre-treated in this way is used, increased strengths and also improved resistance to high atmospheric humidity compared to the untreated metal oxide are found. If, as described, an organic additive is added to the mould material mixture or the particulate metal oxide, it is advantageous to do this before silanization.

In principle, the process of the invention is suitable for producing all casting moulds customary for metal casting, that is to say, for example, cores and moulds. Casting moulds having very thin walled sections or complex deflections may be produced very advantageously thereby. Particularly if an insulating refractory base moulding material or exothermic materials are added to the mould material mixture of the invention, the process of the invention is suitable for producing feeders.

The casting moulds produced from the mould material mixture of the invention and/or by means of the process of the invention have a high strength immediately after their production, though the strength of the casting moulds after curing is not so great as to cause difficulties when the cast item is removed from the casting mould after its production. Furthermore, these casting moulds are highly stable in the presence of elevated atmospheric humidity, that is to say, surprisingly, the casting moulds may be stored without problems even for a relatively long time. A further particular advantage of the casting moulds is their very good stability with respect to mechanical stress, so that even thin-walled sections of the casting mould or sections having extremely complex geometry may be realised without suffering any deformations due to metallostatic pressure during casting. A further object of the invention is therefore a casting mould that has been obtained by the above-described process of the invention.

The casting mould of the invention is generally suitable for metal casting, in particular light metal casting. Particularly advantageous results are obtained in aluminium casting. According to a preferred embodiment, the refractory base moulding material is recirculated by reprocessing a casting mould that has been produced from the mould material mixture of the invention after casting, thereby obtaining a regenerated refractory base moulding material, which may then be used again to produce a mould material mixture, from which more casting moulds may be made.

Regeneration of the used refractory base moulding material is particularly advantageously performed according to a thermal process.

In one embodiment thereof, a used refractory base moulding material is provided, bearing the residue of a binder based on water glass to which a particulate metal oxide, particularly amorphous silicon dioxide, is added. The used refractory base moulding material undergoes thermal treatment, wherein the used refractory base moulding material is heated to a temperature of at least 200° C.

In this context, the entire volume of the used refractory base moulding material should reach this temperature. The period for which the used refractory base moulding material undergoes thermal treatment depends for example on the quantity of used refractory base moulding material, or also on the amount of the water glass-containing binder that still sticks to the used refractory base moulding material. The treatment time also depends on whether the casting form used in the previous casting has already been largely broken down into a sand or if it still contains relatively large fragments or clumps. The progress of the thermal regeneration may be monitored for example by sampling. The sample taken should crumble into loose sand under light mechanical action such as occurs when the casting mould is shaken. The bond between the grains of the refractory base moulding material should have been weakened to such an extent that the thermally treated refractory base moulding material may be sieved without difficulty to separate larger clumps or contaminants. The duration of the thermal treatment may be selected for example in a range from 5 minutes to 8 hours. However, longer or shorter treatment times are also possible. The progress of the thermal regeneration may be monitored for example by determining the acid consumption in samples of the thermally treated foundry sand. Foundry sands such as chromite sand may themselves have basic properties, so the foundry sand affects acid consumption. However, relative acid consumption may be used as a parameter for the progress of the regeneration. For this, first the acid consumption of the used refractory base moulding material intended for reprocessing is determined. In order to observe the regeneration, the acid consumption of the regenerated refractory base moulding material is determined and correlated with the acid consumption of the used refractory base moulding material. Acid consumption in the regenerated refractory base moulding material is preferably reduced by at least 10% as a result of the thermal treatment performed according to the method of the invention. The thermal treatment is preferably continued until the acid consumption has been reduced by at least 20%, particularly at least 40%, especially at least 60%, and most especially at least 80% compared with the acid consumption of the used refractory base moulding material. Acid consumption is expressed in ml of consumed acid per 50 g of the refractory base moulding material, and the analysis is carried out using 0.1 n hydrochloric acid, in similar manner to the method described in VDG instruction sheet P 28 (May 1979). The method for determining acid consumption is explained in greater detail in the examples. The method for regenerating used refractory base moulding material is disclosed more completely in WO 2008/101668 A1.

In the following, the invention will be explained in greater detail by means of examples and with reference to the attached drawing. In the drawing:

FIG. 1: is a representation of the intake duct core used to test the properties of mould material mixtures.

Measurement Methods Used:

AFS number: The AFS number was determined in accordance with VDG instruction sheet P 27 (German Foundry Society, Dusseldorf, October 1999).

Mean grain size: The mean grain size was determined in accordance with VDG instruction sheet P 27 (German Foundry Society, Dusseldorf, October 1999).

Acid consumption: Acid consumption was determined in a manner compliant with the regulation contained in VDG instruction sheet P 28 (German Foundry Society, Dusseldorf, May 1979).

Reagents and Equipment:

Hydrochloric acid 0.1 n

Sodium hydroxide 0.1 n

Methyl orange 0.1%

250 ml plastic bottles (polyethylene)

Calibrated volumetric pipettes

Performance of the Analysis:

If the foundry sand still contains relatively large clumps of bound foundry sand, these clumps are reduced, for example with the aid of a hammer, and the foundry sand is passed through a sieve having a mesh size of 1 mm.

50 ml distilled water and 50 ml 0.1 n hydrochloric acid transferred to the plastic bottle by pipette. Then 50.0 g of the foundry sand for analysis is poured into the bottle through a funnel, and the bottle is sealed. The bottle is shaken vigorously for 5 seconds every minute in the first 5 minutes, and for 5 seconds every 30 minutes thereafter. After each shaking session, the sand is allowed to settle for a few seconds, and the sand sticking to the wall of the bottle is washed off by swirling the bottle briefly. During the rest periods, the bottle is kept at room temperature. After 3 hours, the contents are filtered through a medium filter (white strip, diameter 12.5 cm). The funnel and the beaker used to collect the liquid must both be dry. The first few ml of the filtrate are discarded. 50 ml of the filtrate is pipette into a 300 ml titration flask and 3 drops methyl orange are added thereto as an indicator. Then, the filtrate is titrated from red to yellow with a 0.1 n sodium hydroxide.

Calculation:

(25.0 ml hydrochloric acid 0.1 n−consumed ml sodium hydroxide 0.1 n)×2=ml acid consumption/50 g foundry sand Determination of Bulk Density A measuring cylinder that has been shortened to the 1000 ml marking is weighed. The sample to be tested is then poured into the measuring cylinder through a powder funnel all at once, in such manner that a cone of powder is formed above the measuring cylinder closure. The power cone is scraped off with the aid of a ruler, which is drawn over the opening of the measuring cylinder, and the measuring cylinder is weighed again. The difference corresponds to the bulk density.

EXAMPLE 1

Effect of surface-active materials on the strength and density of casting moulds.

1. Production and Testing of the Mould Material Mixture

The intake duct cores illustrated in FIG. 1 were manufactured for the purpose of testing the mould material mixture.

The composition of the mould material mixture is listed in table 1. In order to produce the intake duct cores, the following work steps were taken:

The components listed in table 1 were mixed in a mixer. For this, the silica sand was introduced first, and the water glass and any surface-active material were added while stirring. A sodium water glass with fractions of potassium was used as the water glass. The ratio $SiO_2$:$M_2O$ in the water glass was about 2.2., where M stands for the total of sodium and potassium. After the mixture had been mixed for a minute, the amorphous silicon dioxide was added as necessary, with continued stirring. The mixture was then stirred for a further minute.

The mould material mixtures were transferred to the storage bin of a 6.5 l core shooting machine manufactured by Roperwerk—Gießereimaschinen GmbH, Viersen, DE, the moulding tool of which had been heated to 180° C.

The mould material mixtures were blown into the moulding tool by compressed air (2 bar), and remained in the moulding tool for a further 50 seconds.

To accelerate curing of the mixtures, hot air was passed through the moulding tool for the last 20 seconds (3 bar, 150° C. at entry into the tool).

The moulding tool was opened and the intake duct was removed.

To determine flexural strengths, the test pieces were placed in a Georg Fischer strength testing instrument equipped with a 3-point bending device (DISA Industrie AG, Schaffhausen, CH), and the force required to break the test bars was measured.

Flexural strengths were measured according to the following scheme:

10 seconds after removal from the moulding tool (hot strengths);

1 hour after removal from the moulding tool (cold strengths)

3 hours' storage of the cooled cores in a controlled-atmosphere cabinet at 30° C. and 75% relative atmospheric humidity.

TABLE 1

Composition of the mould material mixtures

| | Silica sand | Alkaline water glass | Amorphous silicon dioxide | Surface-active material | |
|---|---|---|---|---|---|
| 1.1 | 100 GT | 2.0[a)] | | | Comparison, not acc. to invention |
| 1.2 | 100 GT | 2.0[a)] | 0.5[b)] | | Comparison, not acc. to invention |
| 1.3 | 100 GT | 2.0[a)] | | 0.5[c)] | Comparison, not acc. to invention |
| 1.4 | 100 GT | 2.0[a)] | 0.5[b)] | 0.5[c)] | acc. to invention |
| 1.5 | 100 GT | 2.0[a)] | 0.5[b)] | 0.5[d)] | acc. to invention |
| 1.6 | 100 GT | 2.0[a)] | 0.5[b)] | 0.5[e)] | acc. to |

TABLE 1-continued

| Composition of the mould material mixtures | | | | | |
|---|---|---|---|---|---|
| | Silica sand | Alkaline water glass | Amorphous silicon dioxide | Surface-active material | |
| 1.7 | 100 GT | 2.0[a)] | 0.5[b)] | 0.5[f)] | invention acc. to invention |
| 1.8 | 100 GT | 2.0[a)] | 0.5[b)] | 0.5[g)] | invention acc. to invention |
| 1.9 | 100 GT | 2.0[a)] | 0.5[b)] | 0.10[h)] | invention acc. to invention |
| 1.10 | 100 GT Regenerated[i)] | 2.0[a)] | 0.5[b)] | | Comparison, not acc. to invention |
| 1.11 | 100 GT Regenerated[i)] | 2.0[a)] | 0.5[b)] | 0.5[e)] | acc. to invention |

[a)]Alkaline water glass with ratio $SiO_2$:$M_2O$ of approx 2.2; relative to the total quantity of water glass
[b)]Elkem Microsilica ® 971 (pyrogenic silicic acid; production in electric arc furnace); bulk density 300-450 kg/m$^3$ (manufacturer's data)
[c)]Melpers ® 0030 (polycarboxylate ether in water, manufacturer BASF)
[d)]Melpers ® VP 4547/240 L (modified polyacrylate in water, manufacturer BASF)
[e)]Texapon ® EHS (2-ethylhexyl sulphate in water, manufacturer Cognis)
[f)]Glukopon ® 225 DK (polyglucoside in water, manufacturer Cognis)
[g)]Texapon ® 842 (sodium octyl sulphate in water, manufacturer Lakeland)
[h)]Castament ® FS 60 (modified carboxylate ether, solid, manufacturer BASF)
[i)]thermally treated used sand from mixture 1.6 (90 minutes, 650° C.)

The results of the strength tests are summarised in table 2.

TABLE 2

| Flexural strengths | | | | | |
|---|---|---|---|---|---|
| | Hot strengths [N/cm$^2$] | Cold strengths [N/cm$^2$] | After storage in atm.-controlled cabinet [N/cm$^2$] | Core weight | |
| 1.1 | 80 | 400 | 10 | 1255 | Comparison, not acc. to invention |
| 1.2 | 170 | 410 | 150 | 1256 | Comparison, not acc. to invention |
| 1.3 | 80 | 420 | 10 | 1310 | Comparison, not acc. to invention |
| 1.4 | 180 | 460 | 210 | 1317 | acc. to invention |
| 1.5 | 170 | 450 | 180 | 1315 | acc. to invention |
| 1.6 | 180 | 440 | 200 | 1310 | acc. to invention |
| 1.7 | 160 | 430 | 150 | 1319 | acc. to invention |
| 1.8 | 170 | 440 | 200 | 1321 | acc. to invention |
| 1.9 | 150 | 400 | 210 | 1280 | acc. to invention |
| 1.10 | 140 | 350 | 110 | 1201 | Comparison, not acc. to invention |
| 1.11 | 160 | 410 | 160 | 1299 | acc. to invention |

Result

Mould material mixtures that contain neither amorphous silicon dioxide nor a surface-active material (mixture 1.1) have a hot strength that is insufficient for an automated core production process. Cores produced with this mould material mixture manifest structural irregularities that may result in rejection of the core (low mechanical stability, transfer of weakpoints to the casting profile). This defect profile can be counteracted by increasing the shooting pressure up to 5 bar.

When amorphous silicon dioxide is added to the mould material mixture (mixture 1.2) hot strength is increased significantly. The core weight, which provides information about compaction and flowability, is comparable with that of mixture 1.1. The compaction on the core surface is also comparable with mixture 1.1 and manifests major structural irregularities at 2 bar.

When surface-active substances are used without the addition of amorphous silicon dioxide (mixture 1.3), the core weight may be increased, but there is no positive effect on hot strength. Compaction of the core is improved, so that structural irregularities are less prevalent than in mixtures 1.1 and 1.2.

Only when both base moulding components are used together, that is to say when both amorphous silicon dioxide and surface-active materials are added (mixtures 1.4 to 1.9) are increases in both the hot strength and the core weight observed. The cold strengths as well as moisture stability of mixtures 1.4 to 1.9 record higher values than the moulds using mixtures 1.1 to 1.3. Core compaction is improved due to the increased flowability of the mould material mixture, thus also resulting in greater mechanical stability. Structural irregularities such as appear with mixtures 1.1 and 1.2 are minimal.

A comparison of mixtures 1.10 and 1.11 shows that the addition of surface-active materials is highly advantageous, particularly when regenerated sands (in this case a thermal regenerate) are used. In such a case, the increase in strengths and core weight is even more pronounced than when fresh silica sand is used, for example.

The invention claimed is:

1. A process for producing casting mould or a casting core for metal processing comprising at least the following steps:

providing a refractory base moulding material;

providing a binder by dissolving at least one anionic surfactant in water glass;

providing separate from the binder a particulate metal oxide comprising amorphous silicon dioxide;

obtaining a mould material mixture by mixing at least the refractory base moulding material, the binder with the anionic surfactant dissolved therein and the particulate metal oxide, wherein the anionic surfactant is contained in the mould material mixture from 0.001 to 1% by weight relative to the weight of the refractory base moulding material;

moulding of the mould material mixture into a shape to form a moulded mould material mixture; and curing of the moulded mould material mixture by heating the mould material mixture to obtain the casting mould or the casting core having a flexural hot strength increased by at least 10%, a flexural strength after storage under humid atmosphere increased by at least 20%, and a compaction core weight increased by at least 1%, when compared to a cured casting mould or casting core produced by the same process but without both anionic surfactant and amorphous silicon dioxide, wherein the anionic surfactant comprises a non-polar, hydrophobic portion and a sulphate group, wherein the non-polar, hydrophobic portion is an alkyl group having more than 6 carbon atoms.

2. The process according to claim 1, wherein the anionic surfactant is selected from the group consisting of oleyl sulphate, stearyl sulphate, palmityl sulphate, myristyl sulphate, lauryl sulphate, decyl sulphate, octyl sulphate, 2-ethyloctyl sulphate, 2-ethyldecyl sulphate, palmitoleyl sulphate and linolyl sulphate.

3. The process according to claim 1, wherein the refractory base moulding material comprises a regenerated refractory base moulding material.

4. The process according to claim 1, wherein the mould material mixture further comprises at least one carbohydrate.

5. The process according to claim 1, wherein the mould material mixture further comprises at least one phosphorus-containing compound.

6. The process according to claim 1, wherein the particulate metal oxide is selected from the group consisting of precipitated silicic acid, pyrogenic silicic acid and mixtures thereof.

7. The process according to claim 1, wherein the water glass has an $SiO_2/M_2O$ ratio in the range from 1.6 to 4.0, wherein M stands for sodium ions or potassium ions or both.

8. The process according to claim 1, wherein the mould material mixture comprises less than 20% by weight of the binder.

9. The process according to claim 1, wherein the binder comprises from 2 to 80% by weight particulate metal oxide, relative to the binder.

10. The process according to claim 1, wherein the refractory base moulding material comprises hollow microspheres.

11. The process according to claim 1, wherein the base moulding material contains at least a proportion of glass granules, glass beads, spherical ceramic moulding materials or mixtures thereof.

12. The process according to claim 1, wherein an oxidisable metal and an oxidant are added to the mould material mixture.

13. The process according to claim 1, wherein the mould material mixture comprises an inorganic additive that is solid at room temperature.

14. The process according to claim 1, wherein the mould material mixture comprises at least one silane or siloxane.

15. The process according to claim 1 wherein the mould material mixture is heated to a temperature in the range from 100 to 300° C.

16. The process according to claim 1 wherein heated air is blown into the moulded mould material mixture in order to cure it.

17. The process according to claim 1 wherein heating of the moulded mould material mixture is effected by the action of microwaves.

18. The process according to claim 1 wherein the refractory base moulding material comprises between 10 and 90% by weight regenerated refractory base moulding material obtained from reconditioning refractory base moulding material by at least a heat treatment or mechanical treatment or by both of a mould material mixture previously cured in the presence of a water glass binder and the anionic surfactant increases the flowability of the mould material mixture.

19. The process according to claim 1 wherein mould material mixture is moulded and cured in a core shooting machine and the moulded mould material mixture is cured in the shooting machine.

20. A process for producing a casting mould or a casting core for metal processing comprising at least the following steps:

providing a refractory base moulding material;

providing a binder by dissolving at least one anionic surfactant in water glass, wherein the anionic surfactant comprises a non-polar, hydrophobic portion and a sulphate group, wherein the non-polar, hydrophobic portion is an alkyl group having more than 6 carbon atoms;

providing separate from the binder a particulate metal oxide comprising amorphous silicon dioxide;

obtaining a mould material mixture by mixing at least the refractory base moulding material, the binder and the particulate metal oxide, wherein the anionic surfactant is contained in the mould material mixture from 0.001 to 1% by weight relative to the weight of the refractory base moulding material;

transferring the mould material mixture into a core shooting machine;

moulding of the mould material mixture into a shape in the core shooting machine to form a moulded mould material mixture; and curing of the moulded mould material mixture by heating the moulded mould material mixture in the core shooting machine by blowing heated air into the core shooting machine to obtain the casting mould or the casting core having a flexural hot strength increased by at least 10%, a flexural strength after storage under humid atmosphere increased by at least 20%, and a compaction core weight increased by at least 1%, when compared to a cured casting mould or casting core produced by the same process but without both anionic surfactant and amorphous silicon dioxide.

* * * * *